United States Patent [19]

Pearson

[11] Patent Number: 4,791,968

[45] Date of Patent: Dec. 20, 1988

[54] HEAD FOR SEALLESS STRAPPING MACHINE

[75] Inventor: Timothy B. Pearson, Antioch, Ill.

[73] Assignee: Signode Corporation, Glenview, Ill.

[21] Appl. No.: 132,415

[22] Filed: Dec. 14, 1987

[51] Int. Cl.[4] ..... B21F 9/02

[52] U.S. Cl. ..... 140/93.2; 100/29; 100/33 R

[58] Field of Search ..... 140/93.2, 93.4, 113, 140/150; 29/521; 100/29, 33 R

[56] References Cited

U.S. PATENT DOCUMENTS

| | | | |
|---|---|---|---|
| 2,276,988 | 3/1942 | Leslie | 24/20 EE |
| 3,188,706 | 6/1965 | Partridge | 24/20 EE |
| 3,194,281 | 7/1965 | Frey et al. | 100/29 |
| 3,211,186 | 10/1965 | Bushman | 140/93.4 |
| 3,303,541 | 2/1967 | Beach | 24/20 EE |
| 3,493,014 | 2/1970 | Orban et al. | 140/93.4 |
| 3,811,481 | 5/1974 | Back | 140/93.2 |
| 3,935,616 | 2/1976 | Simmons | 24/20 EE |
| 4,031,594 | 6/1977 | Cepuritis | 24/20 EE |
| 4,048,697 | 9/1977 | Duenser | 24/20 EE |
| 4,062,086 | 12/1977 | Wojcik | 24/20 EE |
| 4,154,158 | 5/1979 | Leslie | 100/2 |
| 4,226,007 | 10/1980 | Duenser | 24/20 EE |
| 4,228,565 | 10/1980 | Lems | 24/20 EE |
| 4,245,678 | 1/1981 | Sansum | 140/93.4 |
| 4,356,845 | 11/1982 | Kimbrough | 140/93.2 |

FOREIGN PATENT DOCUMENTS

| | | | |
|---|---|---|---|
| 2040825 | 9/1980 | United Kingdom | 100/29 |
| 2055321 | 3/1981 | United Kingdom | 140/93.2 |

*Primary Examiner*—Lowell A. Larson

*Attorney, Agent, or Firm*—Dressler, Goldsmith, Shore, Sutker & Milnamow, Ltd.

[57] ABSTRACT

In a strapping head, slitting dies on a pair of pivotally mounted sealing jaws and a longitudinally movable punch on a punch holder cooperate and are adapted to make a sealless connection in two overlapped layers of a tensioned loop of steel strap. A longitudinally movable sealing yoke pivots the sealing jaws by means of cams on the sealing yoke and cam followers on the sealing jaws and moves the punch holder via a connection allowing lost motion between the sealing yoke and the punch holder. A pair of pivotally mounted notching jaws and a pair of notching cutters on a longitudinally movable notching cutter holder cooperate and are adapted to cut notches in opposite edges of the overlapped layers after the sealless connection has been made. A longitudinally movable notching yoke pivots the notching jaws by means of links and moves the cutter holder via a connection allowing lost motion between the notching yoke and the cutter holder. The sealing and notching yokes are arranged such that the sealing yoke moves the notching yoke for certain purposes. Strap-cutting elements are provided, which are adapted to cut the tensioned loop from the remaining strap.

8 Claims, 4 Drawing Sheets

HEAD FOR SEALLESS STRAPPING MACHINE

CROSS-REFERENCE TO ANOTHER APPLICATION

This application incorporates, by reference, the disclosure of U.S. patent application Ser. No. 127,449 filed Dec. 2, 1987, by Donald R. Tremper and Timothy B. Pearson, for SEALLESS STRAP CONNECTION.

FIELD OF THE INVENTION

This invention pertains to improvements in a strapping head for a strapping machine of a type used to make a sealless connection in two overlapped layers of a tensioned loop of a steel strap.

BACKGROUND OF THE INVENTION

A strapping machine of the type noted above is exemplifed in Leslie et al. U.S. Pat. No. 4,154,158. As disclosed therein, a steel strap is fed from a strap dispenser, through a strap chute, and about an article being strapped so as to form a loop with a leading end segment of the strap overlapping an adjacent strap segment. The strap loop is gripped at its leading end while its trailing portions are retracted so as to draw the strap loop from the strap chute, around the article, and so as to tension the strap loop around the article. A sealless connection is made in the overlapped segments, by means of a punch and die assembly, and the layer connecting the strap loop to the remaining strap in the strap dispenser is cut so as to separate the strap loop. These feeding, gripping, tensioning, sealing, and cutting functions are performed by various components of a strapping head.

The Leslie et al. patent noted above refers to Beach U.S. Pat. No. 3,303,541 for further details of the sealless connection. Sealless connections of related interest are disclosed in Leslie U.S. Pat. No. 2,276,988, Partridge U.S. Pat. Nos. 3,188,706, Simmons 3,935,616, Cepuritis U.S. Pat Nos. 4,031,594, Duenser 4,048,697, Wojcik 4,062,086, Duenser 4,226,007, and Lems et al. U.S. Pat. No. 4,228,565.

As disclosed in the patents noted in the preceding paragraph, Z-shaped or other slits punched in two overlapped segments of a tensioned loop strapping form interlockable shoulders, which interlock when the loop is released under retained tension. Except for the Beach patent noted above, these patents also disclose various so-called "anti-reverse" locking features, which prevent relative movement of the overlapped, connected segments in such directions as would unlock the shoulder.

Thus, as an example, Leslie U.S. Pat. No. 2,276,988 discloses parallel transverse cuts made along respective edges of two overlapped, connected segments of strapping after a sealless connection has been made. The cuts form registering fingers, which are downwardly bent about longitudinal axes to prevent relative movement of the overlapped, connected segments in either longitudinal direction.

In the Tremper and Pearson application noted above, improvements in a sealless connection between two overlapped segments of strapping are disclosed. As disclosed therein, notches are cut from overlapped edges of the respective segments into the respective segments after shoulders therein have become interlocked with each other upon shifting of the respective segments longitudinally in relation to each other in a locking direction. The respective segments are formed at the notches, along axes oblique in relation to the respective segments, to prevent shifting of the respective segments in an opposite direction. Similar notches, at which the respective segments are formed similarly, are provided on opposite edges of the respective segments.

SUMMARY OF THE INVENTION

This invention provides improvements in a strapping head for a strapping machine of the type noted above. Thus, the strapping head makes a sealless connection in two overlapped layers of a tensioned loop of steel strap. Also, in a preferred embodiment, the strapping head provides "anti-reverse" locking means, preferably as disclosed in the Tremper and Pearson application noted above.

This invention provides in a strapping head for a strapping machine, in which a sealless connection is made in two overlapped layers of a tensioned loop of steel strap, a combination comprising a pair of sealing jaws mounted in the strapping head for pivotal movement about parallel sealing jaw axes. Each sealing jaw has a driving end and a working end respectively on opposite sides of one of the sealing jaw axes. The sealing jaws are pivotable between opened positions and a closed positions. The combination also comprises slitting dies mounted rigidly to the working ends of the sealing jaws and cam followers mounted operatively to the driving ends of the respective sealing jaws.

Likewise, the combination comprises a sealing yoke mounted in the strapping head for movement longitudinally between a withdrawn position and an extended position. The sealing yoke has a driving end and a working end. The sealing yoke has a sealing jaw-pivoting position between its withdrawn and extended positions. The sealing yoke is adapted to be driven, as by means of a two-stage, reversible, pneumatic piston and cylinder mechanism, between its withdrawn and extended positions. The combination also comprises means linking the sealing jaws to the sealing yoke so as to cause the sealing jaws to pivot from their closed positions to their opened positions upon movement of the sealing yoke from its sealing jaw-pivoting position to its withdrawn position and so as to allow the sealing jaws to pivot from their opened positions to their closed positions upon movement of the sealing yoke from its withdrawn position to its sealing jaw-pivoting position.

Moreover, the combination comprises cams provided on the sealing yoke and adapted to engage the cam followers on the respective sealing jaws upon movement of the sealing yoke between its withdrawn and extended positions. The cams are profiled so as to cause the sealing jaws to pivot from their opened positions to their closed positions upon movement of the sealing yoke from its withdrawn position to its sealing jaw-pivoting position, so as to cause the sealing jaws to remain in their closed positions upon movement of the sealing yoke between its sealing jaw-pivoting and extended positions, and so as to allow the sealing jaws to pivot from their closed positions to their opened positions upon movement of the sealing yoke from its sealing jaw-pivoting position to its withdrawn position.

Furthermore, the combination comprises a punch holder mounted in the strapping head for movement longitudinally in relation to movement of the sealing yoke, the punch holder having a driving end and a working end, a slitting punch mounted rigidly to the working end of the punch holder, and means connecting the driving end of the punch holder to the sealing yoke. Such means connects the driving end of the punch holder to the sealing yoke so as o allow lost motion between the sealing yoke and the punch holder. Preferably, such means connects the driving end of the punch holder to the sealing yoke such that the punch holder does not move with the sealing yoke upon movement of the sealing yoke from its withdrawn position, through a first intermediate position, to a second intermediate position, such that the punch holder moves with the sealing yoke from its second intermediate position to its extended position, such that the punch holder does not move with the sealing yoke upon movement of the sealing yoke from its extended position, through its second intermediate position, to its first intermediate position, and such that the punch holder moves with the sealing yoke upon movement of the sealing yoke from its first intermediate position to its withdrawn position.

Specifically, the punch and dies are adapted to punch interlockable slits into the overlapped layers of the tensioned loop of steel strap, when such layers are disposed between the punch and dies and the sealing yoke is driven from its withdrawn position to its extended position, whereby the sealing jaws are pivoted so as to close the dies and the punch holder is moved so as to drive the punch into the dies. Such slits interlock thereupon, under retained tension in the loop of steel strap, when the sealing yoke is driven oppositely so as to withdraw the punch from the dies, and so as to pivot the sealing jaws from the closed positions.

Thus, a strapping head according to this invention makes a sealless connection, as described above, in two overlapped layers of a tensioned loop of steel strap. Preferably, the strapping head also cuts notches in opposite edges of the overlapped layers after the sealless connection has been interlocked. The overlapped layers may be also formed in a manner disclosed in the Tremper and Pearson application noted above. Alternatively, the notches can form registering fingers, which can be simultaneously bent in a manner disclosed in Leslie U.S. Pat. No. 2,276,988.

When the strapping head is arranged to cut notches in opposite edges of the overlapped layers of a tensioned loop of steel strap after the sealless connection has been interlocked, in a preferred embodiment of this invention, the combination comprises a pair of notching jaws mounted in the strapping head for pivotal movement about parallel notching jaw axes. Each notching jaw has a driving end and a working end respectively on opposite sides of the notching jaw axes. The notching jaws are pivotable between opened positions and closed positions.

Likewise, in the preferred embodiment noted above, the combination comprises a notching yoke mounted in the strapping head for movement longitudinally in relation to the sealing yoke between a withdrawn position and an extended position. The notching yoke has a first intermediate position and a second intermediate position between its withdrawn and extended positions. The notching yoke has a driving end and a working end. The notching yoke is adapted to be selectively driven to and withdrawn from the extended position of the notching yoke, as by means of a one-stage, reversible, pneumatic piston and cylinder mechanism.

Moreover, in the preferred embodiment noted above, the combination comprises a notching cutter holder mounted in the strapping head for movement longitudinally in relation to movement of the notching yoke, a pair of notching cutters provided respectively with cutting edges and mounted to the notching cutter holder in spaced relation to each other, and means connecting the cutter holder to the notching yoke so as to allow lost motion between the notching cutter holder and the notching yoke. Preferably, such means connects the cutter holder to the notching yoke such that the notching cutter holder does not move with the notching yoke upon movement of the notching yoke moves from its withdrawn position, through its first intermediate position, to its second intermediate position, such that the notching cutter holder moves with the notching yoke upon movement of the notching yoke from its second intermediate position to its extended position, and such that the notching cutter holder does not move with the notching yoke upon movement of the notching yoke from its second intermediate position to its first intermediate position, and such that the notching cutter holder moves with the notching yoke upon movement of the notching yoke from its first intermediate position to its withdrawn position.

Furthermore, in the preferred embodiment noted above, the combination comprises means linking the notching jaws to the notching yoke so as to cause the notching jaws to pivot from their opened positions to their closed positions upon movement of the notching yoke from its withdrawn position to its extended position and so as to cause the clamping jaws to pivot from their closed positions to their opened positions upon movement of the notching yoke from its extended position to its withdrawn position.

Additionally, in the preferred embodiment noted above, the combination comprises means causing the notching yoke to move with the sealing yoke to the extended position of the sealing yoke. Preferably, such means is arranged such that the notching yoke does not move with the sealing yoke upon movement of the sealing yoke from its extended position to its withdrawn position, such that the notching yoke does not move with the sealing yoke upon movement of the sealing yoke from its withdrawn position to a notching yoke-engaging position between its withdrawn and extended positions, and such that the notching yoke moves with the sealing yoke upon movement of the sealing yoke from its notching yoke-engaging position to its extended position. The withdrawn position of the notching yoke corresponds to the notching yoke-engaging position of the sealing yoke.

Specifically, the notching cutters cooperate with the working ends of the notching jaws and are adapted to notch opposite edges of such layers when the notching yoke is driven from a position corresponding to the extended position of the sealing yoke to the extended position of the notching yoke, whereby such edges can be so notched after such slots have interlocked.

In a broad sense, such notching jaws, notching yoke, cutter holder, notching cutters, and linking means may be similarly combined, in a strapping head having different sealing components, so as to provide an alternative embodiment of this invention.

As further features, particularly but not exclusively in the preferred embodiment noted above, the combination may comprise a fixed strap-cutting blade mounted fixedly in the strapping head and a movable strap-cutting blade mounted for movement with the sealing yoke. If provided, the fixed and movable strap-cutting blades are adapted to cut one of the overlapped layers of the tensioned loop of steel strap when the punch and dies punch such slits into such layers.

These and other objects, features, and advantages of this invention will be evident from the following description of the preferred embodiment noted above, with reference to the accompanying drawings.

DETAILED DESCRIPTION OF PREFERRED EMBODIMENT

Figure 2:
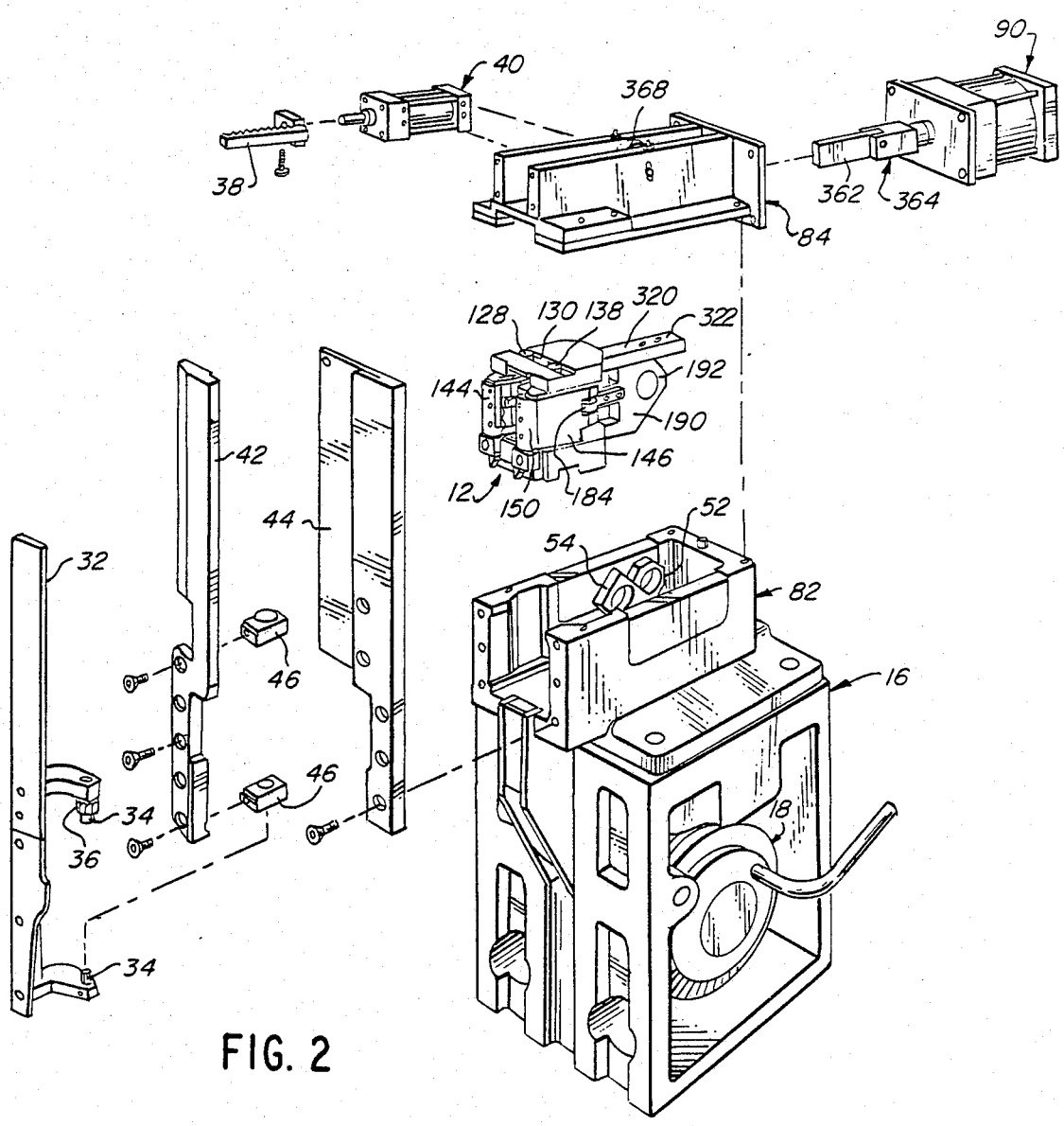
FIG. 2 is an exploded, perspective view of various components of the strapping head shown in FIG. 1.
Figure 3:
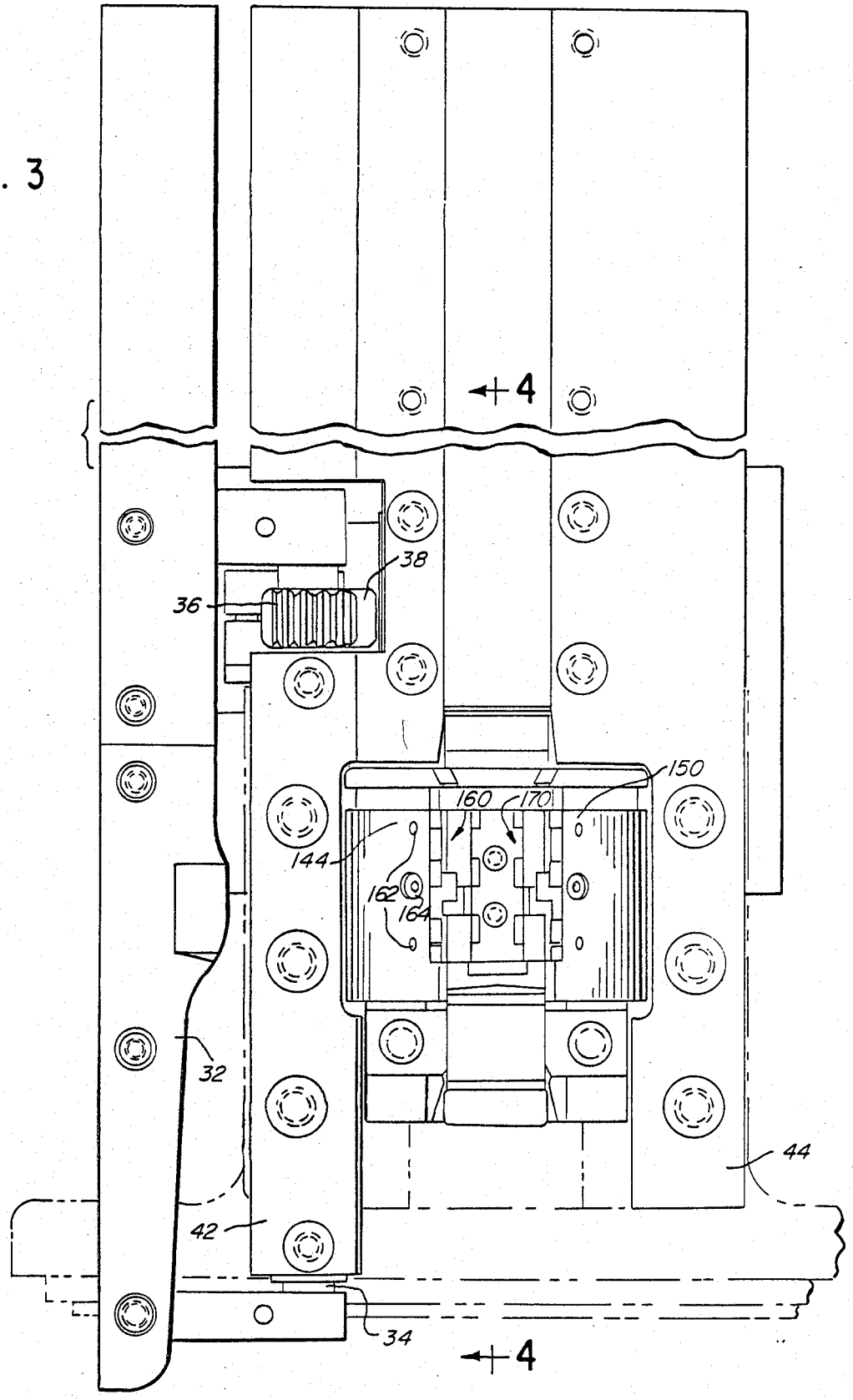
FIG. 3 is a front elevational view of the strapping head shown in FIG. 1, certain components outside the scope of this invention being shown in phantom lines.

As shown in the drawings, a strapping head 10 incorporates a preferred embodiment of this invention. Certain components of the strapping head 10 are similar to components of the SIGNODE M40-114 Strapping Machine Head, as manufactured and distributed by Signode Corporation, Glenview, Ill. 60025, United States of America. Precise details of the similar components are outside the scope of this invention. The SIGNODE M40-114 Strapping Machine Head is designed to apply a metal seal to two overlapped layers (segments) of a tensioned loop of steel strap, not to make a sealless connection, which the strapping head 10 is designed to make. However, other components of the strapping head 10 are novel, as described below. Many of the novel components are assembled into a sealing and notching module 12, as shown in FIG. 2.

Apart from the sealing and notching module 12, the strapping head 10 comprises a housing 16, in which a two-stage, reversible, pneumatic piston and cylinder mechanism (not shown except for a piston to be later described) is mounted. The pneumatic mechanism, which is controlled by various timing and sensing devices, drives various components, which perform the sealing and cutting functions of the strapping head 10. Other feeding and tensioning functions are performed by components similar to components of the SIGNODE M40-114 Strapping Machine Head.

Figure 1:
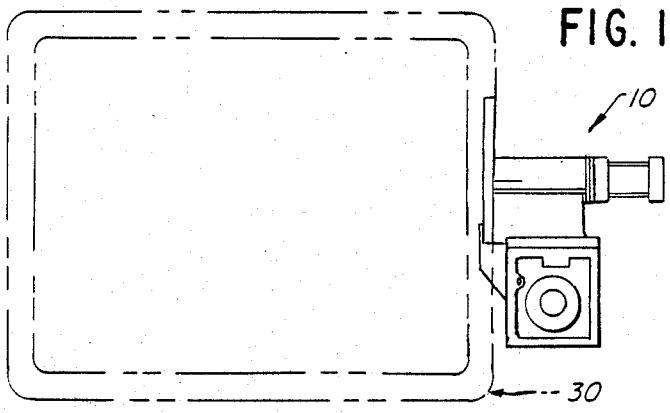
FIG. 1 is a semi-diagrammatic, side elevational view of a strapping machine including a strapping head, which constitutes a preferred embodiment of this invention.

The strapping head 10 is a principal subassembly of a strapping machine, which is not shown otherwise, except for a strap chute 30 that is shown semi-diagrammatically, in phantom lines, in FIG. 1. The strapping head 10 feeds a length of steel strap (not shown) from a strap dispenser (not shown), through the strapping head 10, through the strap chute 30, around a package (not shown) being strapped, and again through the strapping head 10, so as to form a loop of the strap around the package. The strapping head 10 draws the loop of strapping from the strap chute 30, which releases the strap in a known manner, and draws the strap into a tensioned loop around the package. These feeding and tensioning functions, which are conventional in a strapping machine, are performed by components outside the scope of this invention. This invention enables the strapping head 10 to make a sealless connection in the tensioned loop.

Figure 5:
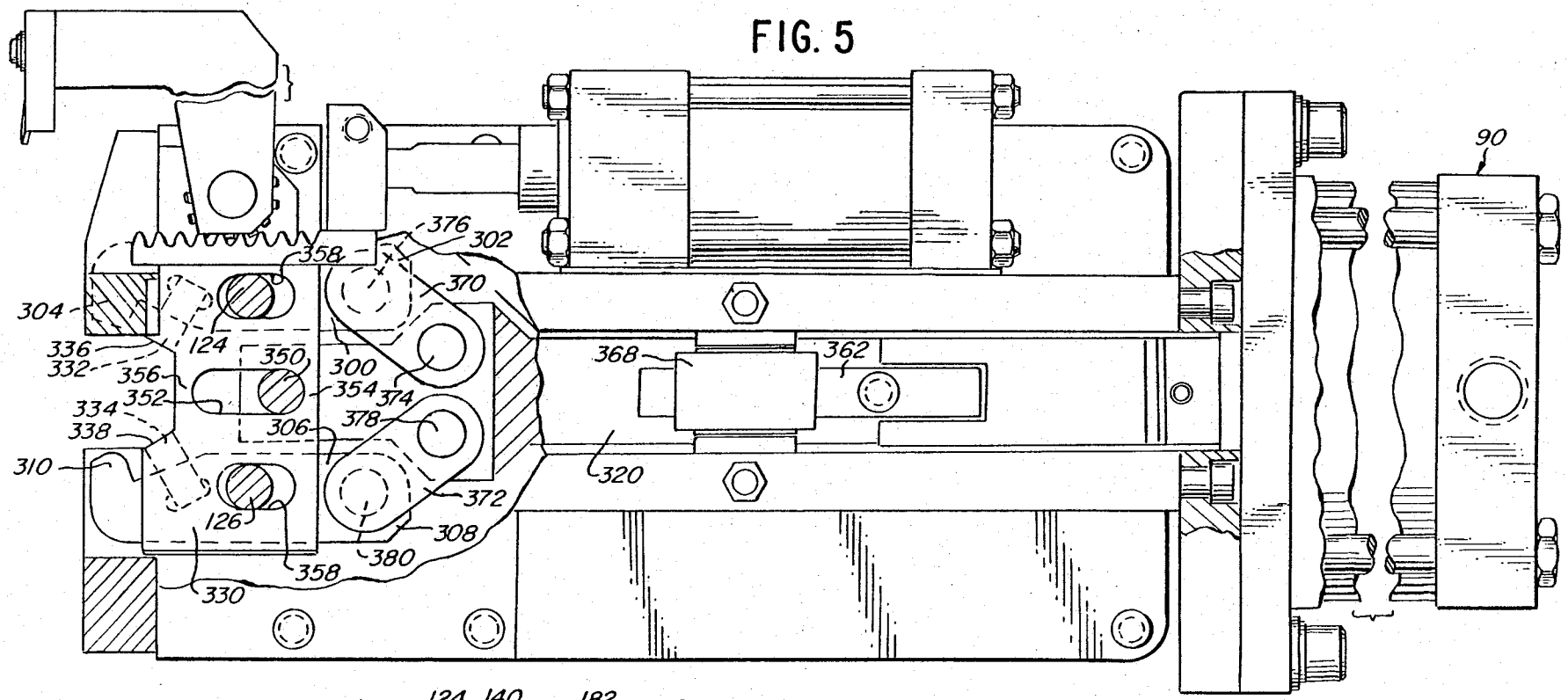
FIG. 5 is a top plan view of the strapping head shown in FIG. 1, certain portions being broken away, essentially along a horizontal plane, so as to reveal other portions.
Figure 6:
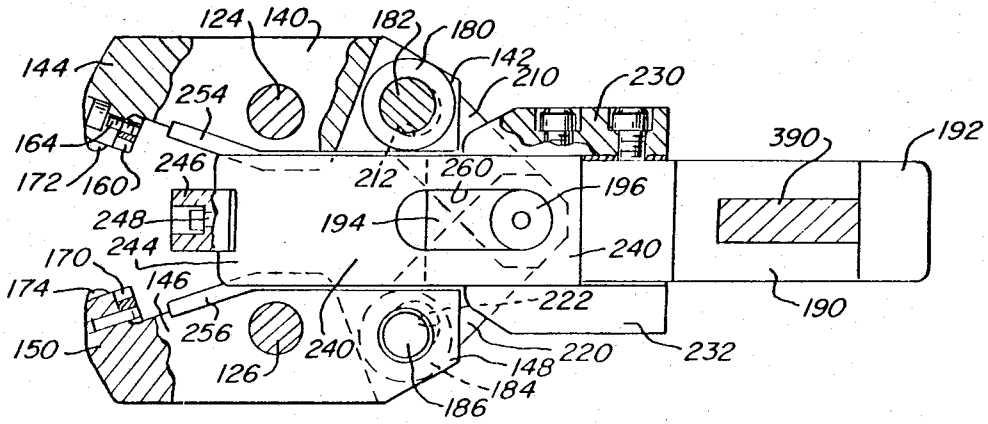
FIG. 6 is a sectional view of certain components of the strapping head, as taken along line 6—6 of FIG. 4 in a direction indicated by arrows.

Apart from the sealing and notching module 12, the strapping head 10 comprises a face gate 32, which is mounted for pivotal movement about vertically spaced pivot pins 34 defining a vertical axis, and a rack and pinion assembly, which operates the face gate 32. The rack and pinion assembly comprises a pinion 36, which is integral with the upper pivot pin 34, and a rack 38 which is mounted for movement longitudinally in either direction, and which engages the pinion 36. A one-stage, reversible, pneumatic piston and cylinder mechanism 40, which is mounted on the housing 16, is connected to the rack 38 so as to drive the rack 38 longitudinally in either direction. Thus, as in the SIGNODE M40-114 Strapping Machine Head, the face gate 32 is pivotable selectively between a closed position wherein the face gate 32 helps to position the overlapped layers of steel strap for sealing and an open position (see FIG. 5) wherein the face gate 32 is withdrawn. Also, as in the SIGNODE M40-114 Strapping Machine Head, the face gate 32 has an intermediate position wherein the face gate 32 helps to position the strap for feeling. When pivoted to its operative position, the face gate 32 fits between a left frame 42 and a right frame 44, each frame being mounted to the housing 16 by means of machine screws. The left frame 42 supports vertically spaced sockets 46, which respectively receive the respective pivot pins 34.

The two-stage pneumatic piston and cylinder mechanism noted above, via its piston 50, drives a toggle linkage comprising a pair of parallel links 52 (one shown) and a link 54. Each link 52 has an upper end 56, which is mounted pivotally to the housing 16 by means of a pivot pin (not shown), and a lower end 60, which is connected pivotally to a midportion of the link 54 by means of a pivot pin (not shown). The link 54 has a lower end 64, which is connected to the piston 50 by means of a pivot pin (not shown), and an upper end 70, which is connected to a sealing yoke to be later described by means of a pivot pin (not shown). The sealing yoke is one component of the sealing and notching module 12.

As shown, the sealing and notching module 12 is mounted in an upper portion 82 of the housing 16 and is covered to some extent by a superstructure 84, which is mounted on the upper portion 82 of the housing 16. The pneumatic mechanism 40 is mounted on the left side of the superstructure 84. The frames 42 and 44 hold the module 12 in the upper portion 82 of the housing 16, beneath the superstructure 84, and separate the package being strapped from the module 12. The module 12 may be pulled from the upper portion 82 of the housing 16, as for servicing of the module 12, if the frames 42 and 44 are removed. A one-stage, reversible, piston and cylinder mechanism 90 is mounted to the superstructure 84 for a purpose to be later described.

The module 12 comprises an upper block 120 and a lower block 122. The blocks 120 and 122 are assembled to each other in a suitable manner. A pair of similar, vertical pins 124 and 126 respectively are mounted in the module 12. As shown, the pin 124 has an enlarged, non-circular head 128, which is fitted into a groove 130 in the upper block 120. A bolt having an enlarged head 132 is passed through a washer 134 and threaded into a lower end 136 of the pin 124. Similarly, the pin 126 has an enlarged, non-circular head 138 (see FIG. 2), which is fitted into the groove 130. A similar bolt (not shown) is passed through a similar washer (not shown) and threaded into the lower end (not shown) of the pin 126.

A sealing jaw 140, which has a driving end 142 and a working end 144, is mounted in the module 12 for pivotal movement about the axis of the pin 124. A sealing jaw 146, which has a driving end 148 and a working end 150, is mounted in the module 12 for pivotal movement about the axis of the pin 126.

A set of slitting dies 160 are mounted to the working end 144 of the sealing jaw 140 by means of a pair of roll pins 162 and a machine screw 164. A set of slitting dies 170 are mounted to the working end 150 of the sealing jaw 146 in a similar manner. An extremity of the working end 144 of the sealing jaw 140 serves as a movable gripping means 172. An extremity of the working end 150 of the sealing jaw 142 serves as a movable gripping means 174. The movable gripping means 172 and 174 cooperate with fixed gripping means to be later described.

A roller 180, which serves as a cam follower, is mounted operatively to the driving end 142 of the sealing jaw 140 by means of a pin 182 serving as a shaft for the roller 180. A roller 184, which serves as a cam follower, is mounted operatively to the driving end 148 of the sealing jaw 142 by means of a pin 186 serving as a shaft for the roller 184.

As mentioned above, the sealing yoke 190, which has a driving end 192 and a working end 194, is mounted in the module 12 for movement longitudinally between a withdrawn position, in which the sealing yoke 190 is shown, and an extended position. The sealing yoke 190 has intermediate positions including a first intermediate position and a second intermediate position, as well as a notching yoke-engaging position and a sealing jaw-pivoting position, either or both of which may but do not have to correspond to the first intermediate position, between the withdrawn and extended positions. As mentioned above, the upper end 70 of the link 54 is connected to the driving end 192 of the sealing yoke 190 by means of a pivot pin. Thus, the sealing yoke 190 is adapted to be driven, by means of the two-stage pneumatic mechanism noted above, between its withdrawn and extended positions. A first stage of the same pneumatic mechanism drives the sealing yoke 190 between its withdrawn and second intermediate positions with its first intermediate position therebetween. A second stage of the same pneumatic mechanism drives the sealing yoke 190 between its second intermediate and extended positions.

A vertical pin 196 is mounted to the sealing yoke 190 so as to move with the sealing yoke 190. The vertical pin 196 is seated in a suitable aperture 98 in a lower, forwardly extending portion 200, of the sealing yoke 190 and in a suitable aperture 202 in an upper, forwardly extending portion 204 of the sealing yoke 190.

The sealing jaw 140 is linked to the sealing yoke 190 by means of a link 210, which has a circular aperture receiving the pin 196, and which has an elongated aperture 212 receiving the pin 182. The sealing jaw 146 is linked to the sealing yoke 190 by means of a link 220, which has a circular aperture receiving the pin 196, and which has an elongated aperture 222 receiving the pin 186. As shown, the link 210 overlies the link 220. The links 210 and 220 link the sealing jaws 140 and 146 to the sealing yoke 190 so as to cause the sealing jaws 140 and 146 to pivot from their closed positions to their opened positions upon movement of the sealing yoke 190 from its sealing jaw-pivoting position to its withdrawn position and so as to allow the sealing jaws 140 and 146 to pivot from their opened positions to their closed positions upon movement of the sealing yoke 190 from its withdrawn position to its sealing jaw-pivoting position. The links 210 and 220 are not used, however, to cause the sealing jaws 140 and 146 to pivot from their opened positions to their closed positions.

Cams 230 and 232 respectively, which are mounted rigidly to the sealing yoke 190 by means of machine screws, one such cam being on each side of the sealing yoke 190, are adapted respectively to engage the rollers 180 and 184 upon movement of the sealing yoke 190 between its withdrawn and extended positions. Shims are inserted, if and as needed, between each of the cams 230 and 232 and the adjacent sides of the sealing yoke 190. The cams 230 and 232 are profiled so as to cause the sealing jaws 140 and 146 to pivot from their opened positions to their closed positions upon movement of the sealing yoke 190 from its withdrawn position to its sealing jaw-pivoting position, so as to cause the sealing jaws 140 and 146 to remain in their closed positions upon movement of the sealing yoke between its sealing jaw-pivoting and extended positions, so as to allow the sealing jaws 140 and 146 to pivot from their closed positions to their opened positions upon movement of the sealing yoke 190 from its sealing jaw-pivoting position to its withdrawn position. The apertures 212 and 222 are elongated, not circular, so as to avoid interference during such camming action. Thus, pivotal movement of the sealing jaws 140 and 146 is controlled with great precision, which is needed to effectively make a sealless connection. Clearances between a punch to be later described and the dies 160 and 170 remain constant throughout their slitting action.

The module 12 includes a punch holder 240, which has a driving end 242 and a working end 244, and which is mounted in the module 12 for movement longitudinally in relation to the sealing yoke 190, and a slitting punch 246, which is mounted rigidly to the working end 244 of the punch holder 240 by means of machine screws 248. As shown, the punch holder 240 has an upper, rearwardly extending portion 250 and a lower, rearwardly extending portion 252, and the upper portion 204 of the sealing yoke 190 fits slidably between the upper and lower portions 250 and 252 respectively.

As shown, keys 254 and 256 being fixed to the sealing jaws 140 and 146 respectively and fitting slidably into keyways (not shown) in the punch holder 240 serve to keep the sealing jaws 140 and 146 and the punch holder 240 in proper alignment.

Figure 4:
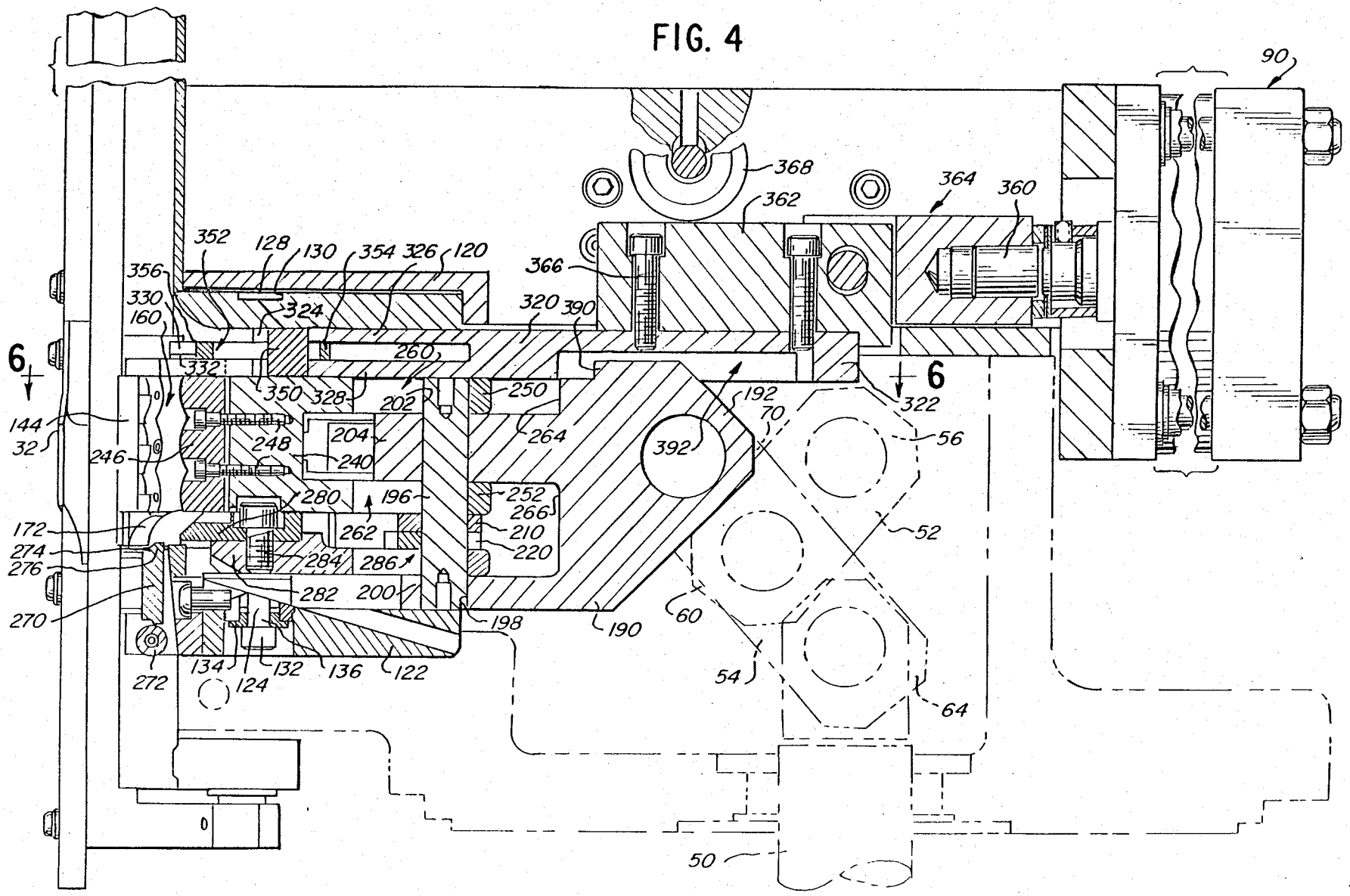
FIG. 4 is a sectional view of certain components of the strapping head, as taken along line 4—4 of FIG. 3 in a direction indicated by arrows, other components outside, the scope of this invention being shown in phantom lines.

The pin 196 extends through an elongated slot 260 in the upper portion 250 of the punch holder 240 and through a similar slot 262 in the lower portion of the punch holder 240 so as to connect the driving end 242 of the punch holder 240 to the sealing yoke 190. The elongated slots 260 and 262 allow lost motion between the sealing yoke 190 and the punch holder 240. Such lost motion entails that the punch holder 240 does not move with the sealing yoke 190 upon movement of the sealing yoke 190 from its withdrawn position, in which the pin 196 engages back margins (i.e., right margins, as shown in FIG. 4) of the elongated slots 260 and 262, through a first intermediate position, to a second intermediate position, in which the pin 196 engages front margins (i.e., left margins, as shown in FIG. 4) of the elongated slots 260 and 262. Additionally, when the sealing yoke 190 moves to its second intermediate position, front-facing surfaces 264 and 266 respectively engage the upper and lower portions 250 and 252 of the punch holder 240. Such lost motion also entails that the punch holder 240 moves with the sealing yoke 190 upon movement of the sealing yoke 190 from its second intermediate position to its extended position, that the punch holder 240 does not move with the sealing yoke 190 upon movement of the sealing yoke 190 from its extended position, through its second intermediate position, to its first intermediate position, in which the pin 196 again engages back margins of the elongated slots 260 and 262, and that the punch holder 240 moves with the sealing yoke 190 upon movement of the sealing yoke 190 from its first intermediate position to its withdrawn position. Frictional drag between the punch holder 190 and the sealing yoke 190 is addressed in a manner to be later described.

The punch 246 and the dies 160 and 170 are adapted to punch interlockable slits into the overlapped layers (segments) of the tensioned loop of steel strap, noted above, when such layers (segments) are disposed between the punch 246 and the dies 160 and 170 and the sealing yoke 190 is driven, via the camming action noted above, by the first stage of the two-stage pneumatic mechanism noted above (and without the punch holder 240) from the withdrawn position of the sealing yoke 190, through its first intermediate position, to its second intermediate position and by the second stage of the same pneumatic mechanism (and with the punch holder 240) from the second intermediate position of the sealing yoke 190 to its extended position. Such slits interlock thereupon, under retained tension in the loop of steel strap, when the sealing yoke 190 is driven, via the links 210 and 220, by the respective stages of the same pneumatic mechanism so as to withdraw the punch 246 from the dies 160 and 170, and so as to pivot the sealing jaws 140 and 146 from their closed position.

Precise details of the cutting edges of the punch 246 and the dies 140 and 146 may be readily supplied by persons skilled in the art, who may refer to, inter alia, Leslie et al. U.S. Pat. No. 4,154,158 and other patents noted above.

As shown in FIG. 4, a gripping and cutting element 270 is mounted rigidly in the module 12 above a roller 272, which is mounted operatively in the module 12. An upper, front edge 274 of the element 270 cooperates with the movable gripping means 17 and 174 noted above, when the sealing jaws 140 and 146 are pivoted to their closed positions, so as to grip one layer o the strap at a location near the leading end of the strap, below the overlapped layers of the strap. The roller 272 helps to guide the strap. The element 270 has an upper, back edge serving as a fixed strap-cutting blade 276 for a purpose to be next described.

As shown also in FIG. 4, a movable strap-cutting blade 280 is mounted to a blade holder 282 by means of a machine screw 284, and the blade holder 282 is mounted so as to move with the punch holder 240. Thus, the blade holder 282 has an elongated slot 286, which is like the elongated slots 260 and 262 in the punch holder 240, and which coacts similarly with the pin 196. The fixed cutting blade 276 and the movable cutting blade 280 cooperate and are adapted to cut one layer of the tensioned loop so as to cut the tensioned loop from the remaining strap in the strap dispenser.

If frictional drag between the punch holder 240 and the sealing yoke 190 causes the punch holder 240 to move prematurely in a frontward direction, engagement of the movable strap-cutting blade 280 with the strap limits such movement of the punch holder 240.

Similar strap-cutting means have been employed in prior strapping heads of types applying metal seals, e.g., the SIGNODE M40-114 Strapping Machine Head.

Accordingly, the strapping head 10 makes a sealless connection, as described above, in the overlapped layers of the tensioned loop of steel strap noted above. Additionally, as described below, the strapping head 10 cuts notches in opposite edges of the overlapped layers after the sealless connection and forms the overlapped layers at the notches, in a manner disclosed in the Tremper and Pearson application noted above, so as to provide the overlapped, connected layers with "anti-reverse" locking means.

In order to cut notches in opposite edges of the overlapped layers after the sealless connection has been made, the module 12 also comprises a notching jaw 300, which has a driving end 302 and a working end 304, and a notching jaw 306, which has a driving end 308 and a working end 310. The notching jaw 300 is mounted pivotally in the module 12 by means of the pin 124, which extends through a circular aperture in the notching jaw 300. The notching jaw 306 is mounted pivotally in the module 12 by means of the pin 126, which passes through a circular aperture in the notching jaw 306. The notching jaws 300 and 306 are pivotable between opened positions, in which the notching jaws 300 and 306 are shown, and closed positions.

Likewide, the module 12 comprises a notching yoke 320, which has a driving end 322 and a working end 324. The notching yoke 320 is mounted in the module 12 for movement longitudinally in relation to the sealing yoke 190 between a withdrawn position, in which the notching yoke 320 is shown, and an extended position. The notching yoke 320 is adapted to be selectively driven to and withdrawn from its extended position by means of the one-stage, reversible, pneumatic piston and cylinder mechanism 20. As shown in FIG. 4, the working end 324 of the notching yoke 320 has an upper, forwardly extending portion 326 and a lower, forwardly extending portion 328.

Moreover, the module 12 comprises a notching cutter holder 330, which is mounted in the module 12 for movement longitudinally in relation to the notching yoke 320 and thus in relation to the sealing yoke 190, and a pair of notching cutters 332 and 334 respectively, which are provided with cutting edges 336 and 338 respectively, and which are mounted rigidly to the notching cutter holder 330 by means of roll pins 340 and 342 respectively. A pin 350, which is fitted into circular apertures respectively in the upper and lower portions 326 and 328 respectively of the working end 324 of the notching yoke 320, extends through an elongated slot 352 in the notching cutter holder 330 so as to connect the notching cutter holder 330 to the notching yoke 320, and so as to allow lost motion between the notching cutter holder 330 and the notching yoke 320. Such lost motion entails that the notching cutter holder 330 does not move with the notching yoke 320 upon movement of the notching yoke 320 from its withdrawn position, in which the pin 350 engages a back margin 354 of the slot 352, through a first intermediate position, to a second intermediate position, in which the pin 350 engages a front margin 356 of the slot 352. Such lost motion entails also that the notching cutter holder 330 moves with the notching yoke 320 upon movement of the notching yoke 320 from its second intermediate position to its extended position, such that the notching cutter holder 330 does not move with the notching yoke 320 upon movement of the notching yoke 320 from its extended position, through its second intermediate position, to its first intermediate position, in which the pin 350 again engages the back margin 354 of the slot 352, and that the notching cutter holder 330 moves with the notching yoke 320 upon movement of the notching yoke 320 moves from its first intermediate position to its withdrawn position. Elongated slots 358 in the notching cutter holder 330 provide clearance for the pins 124 and 126.

As shown, the pneumatic mechanism 90 comprises a piston 360, which is connected to a block 362 by means of a clevis 364. The block 362 is fixed to the notching yoke 320 by means of machine screws 366. A roller 368, which is journalled in the superstructure 84, bears on the block 362 so as to stabilize the notching yoke 320 yet permit longitudinal movement of the notching yoke 320.

Furthermore, the notching jaw 300 is linked to the notching yoke 320 by means of a link 370 and the notching jaw 306 is linked to the notching yoke 320 by means of a link 372, so as to cause the notching jaws 300 and 306 to pivot from their opened positions to their closed positions upon movement of the notching yoke 320 from its withdrawn position to its extended position and so as to cause the notching jaws 300 and 306 to pivot from their closed positions to their opened positions upon movement of the notching yoke 320 from its extended position to its withdrawn position. Specifically, the link 370 is connected pivotally to the notching yoke 320 by means of a pin 374 and to the driving end 302 of the notching jaw 300 by means of a pin 376, which may be integral with the link 370. Similarly, the link 372 is connected pivotally to the notching yoke 320 by means of a pin 378 and to the driving end 308 of the notching jaw 306 by means of a pin 380, which may be integral with the link 370.

Additionally, an upper, integral appendage 390 of the sealing yoke 190 fits slidably into a groove 392, which is formed in the notching yoke 320, so as to drive the notching yoke 320 from the sealing yoke 190. By fitting slidably into the groove 392, the appendage 390 keeps the notching yoke 320 and the sealing yoke 190 in proper alignment. The notching yoke 320 is driven from the sealing yoke 190 such that the notching yoke 320 does not move with the sealing yoke 190 upon movement of the sealing yoke 190 from its extended position to its withdrawn position, such that the notching yoke 320 does not move with the sealing yoke 190 upon movement of the sealing yoke 190 from its withdrawn position to its notching yoke-engaging position (which, as noted above, may correspond to its first intermediate position) between its withdrawn and extended positions, and such that the notching yoke 320 moves with the sealing yoke 190 upon movement of the sealing yoke 190 from its notching yoke-engaging position to its extended position. The withdrawn position of the notching yoke 320 corresponds to the notching yoke-engaging position of the sealing yoke 190.

Thus, the sealing yoke 190 moves the notching yoke 320 from the withdrawn position of the notching yoke 320 to a position corresponding to the extended position of the sealing yoke 320. Thus, the notching jaws 300 and 306 are moved to their closed positions, in which the notching jaws 300 and 306 prevent the tensioned loop of steel strap from being pulled, by retained tension, against the package being strapped. Also, the pneumatic mechanism 90 may be then pressurized to a low level (as by air exhausted from the two-stage pneumatic mechanism noted above) so as to prevent the notching yoke 320 from being withdrawn under frictional drag, when the sealing yoke 190 is withdrawn. The pneumatic mechanism 90, which is unpressurized at each end (so as to enable the piston 360 to move freely) when the sealing yoke 190 moves the notching yoke 320, moves the notching yoke 320 from its position corresponding to the extended position of the sealing yoke 320 to the extended position of the notching yoke 320. The pneumatic mechanism 20 also is used to move the notching yoke 320 from its extended position to its withdrawn position corresponding to the notching-jaw engaging position of the sealing yoke 190.

Specifically, the notching cutters 332 and 334 cooperate with the working ends 304 and 310 respectively of the notching jaws 300 and 306 respectively and are adapted to notching opposite edges of such layers and to form such layers where notched, in the manner disclosed in the Tremper and Pearson application noted above, when the notching yoke 320 is driven from its position corresponding to the extended position of the sealing yoke 190 to the extended position of the notching yoke 320.

In an alternative embodiment (not shown) of this invention, notching jaws similar to the notching jaws 300 and 306, a notching yoke similar to the notching yoke 320, a notching cutter holder similar to the notching cutter holder 330, notching cutters similar to the notching cutters 332 and 334, and links similar to the links 370 and 372 may be similarly combined in a strapping head (not shown) having different sealing components.

In another alternative embodiment (not shown) of this invention, the notching cutters 332 and 334 may be replaced by notching cutters (not shown) adapted to cut and bend registering fingers in two overlapped layers of a tensioned loop of steel strap (not shown) in a manner disclosed in Leslie U.S. Pat. No. 2,276,988.

Various other modifications may be made without departing from the scope and spirit of this invention.

I claim:

1. In a strapping head for a strapping machine, in which a sealless connection is made in two overlapped layers of a tensioned loop of steel strap, a combination comprising:

(a) a pair of sealing jaws mounted in the strapping head for pivotal movement about parallel sealing jaw axes, each sealing jaw having a driving end and a working end respectively on opposite sides of one of the sealing jaw axes, the sealing jaws being pivotable between opened positions and closed positions;

(b) slitting dies mounted rigidly to the working ends of the respective sealing jaws, (c) cam followers mounted operatively to the driving ends of the respective sealing jaws;

(d) a sealing yoke mounted in the strapping head for movement longitudinally between a withdrawn position and an extended position, the sealing yoke having a driving end and a working end, the sealing yoke having intermediate positions including a sealing jaw-pivoting position between the withdrawn and extended positions and being adapted to be driven between the withdrawn and extended positions;

(e) means linking the sealing jaws to the sealing yoke so as to cause the sealing jaws to pivot from the closed positions to the opened positions upon movement of the sealing yoke from the sealing jaw-pivoting position to the withdrawn position and so as to allow the sealing jaws to pivot from the opened positions to the closed positions upon movement of the sealing yoke from the withdrawn position to the jaw-pivoting position, (f) cams provided on the sealing yoke and adapted respectively to engage the cam followers on the respective sealing jaws upon movement of the sealing yoke between the withdrawn and extended positions, the cams being profiled so as to cause the sealing jaws to pivot from the opened positions to the closed positions upon movement of the sealing yoke from the withdrawn position to the sealing jaw-pivoting position, so as to cause the sealing jaws to remain in the closed positions upon movement of the sealing yoke between the sealing jaw-pivoting and extended positions, and so as to allow the sealing jaws to pivot from the closed positions to the opened positions upon movement of the sealing yoke from the sealing jaw-pivoting position to the withdrawn position;

(g) a punch holder mounted in the strapping head for movement longitudinally in relation to movement of the sealing yoke, the punch holder having a driving end and a working end;

(h) a slitting punch mounted rigidly to the working end of the punch holder; and (i) means connecting the driving end of the punch holder to the sealing yoke so as to allow lost motion between the sealing yoke and the punch holder;

the punch and dies being adapted to punch interlockable slits into the overlapped layers of the tensioned loop of steel strap, when such layers are disposed between the punch and dies and the sealing yoke is driven from the withdrawn position, through the sealing jaw-pivoting position, to the extended position, whereby the sealing jaws are pivoted so as to close the dies and the punch holder is moved so as to drive the punch into the dies, and whereupon such slits interlock, under retained tension in the loop of steel strap, when the sealing yoke is driven oppositely so as to withdraw the punch from the dies and so as to pivot the sealing jaws from the closed positions.

2. The combination of claim 1 wherein the sealing yoke has a first intermediate position and a second intermediate position between the withdrawn and extended positions, and wherein the means (i) connects the driving end of the punch holder to the sealing yoke such that the punch holder does not move with the sealing yoke upon movement of the sealing yoke from the withdrawn position, through the first intermediate position, to the second intermediate position, such that the punch holder moves with the sealing yoke upon movement of the sealing yoke from the second intermediate position to the extended position, such that the punch holder does not move with the sealing yoke upon movement of the sealing yoke from the extended position, through the second intermediate position, to the first intermediate position, and such that the punch holder moves with the sealing yoke upon movement of the sealing yoke from the first intermediate position to the withdrawn position.

3. The combination of claim 1 or 2 further comprising:

(j) a pair of notching jaws mounted in the strapping head for pivotal movement about parallel notching jaw axes, each notching jaw having a driving end and a working end respectively on opposite sides of one of the notching jaw axes, the notching jaws being pivotable between opened positions and closed positions;

(k) a notching yoke mounted in the strapping head for movement longitudinally between a withdrawn position and an extended position, the notching yoke having a driving end and a working end, the notching yoke being adapted to be selectively driven to and withdrawn from the extended position of the notching yoke;

(l) a notching cutter holder mounted in the strapping head for movement longitudinally in relation to movement of the notching yoke;

(m) a pair of notching cutters provided respectively with cutting edges and mounted to the notching cutter holder in spaced relation to each other;

(n) means connecting the notching cutter holder to the notching yoke so as to allow lost motion between the notching cutter holder and the notching yoke;

(o) means linking the notching jaws to the notching yoke so as to cause the notching jaws to pivot from the opened positions of the notching jaws to the closed positions of the notching jaws upon movement of the notching yoke from the withdrawn position of the notching yoke to the extended position of the notching yoke and so as to cause the notching jaws to pivot from the closed positions of the notching jaws to the opened positions of the notching jaws upon movement of the notching yoke from the extended position of the notching yoke to the withdrawn position of the notching yoke; and (p) means causing the notching yoke to move with the sealing yoke to the extended position of the sealing yoke;

the notching cutters cooperating with the working ends of the notching jaws and being adapted to notch opposite edges of such layers, when the notching yoke is driven from a position corresponding to the extended position of the sealing yoke to the extended position of the notching yoke after such slits have been cut in such layers and have interlocked, whereby such edges can be so notched after such slits have interlocked.

4. The combination of claim 3 wherein the means (p) is arranged such that the notching yoke does not move with the sealing yoke upon movement of the sealing yoke from the extended position of the sealing yoke to the withdrawn position of the sealing yoke, such that the notching yoke does not move with the sealing yoke upon movement of the sealing yoke from the withdrawn position of the sealing yoke to a notching yoke-engaging position between the withdrawn and extended positions of the sealing yoke, and such that the notching yoke moves with the sealing yoke upon movement of the sealing yoke from the notching yoke-engaging position to the extended position of the sealing yoke, the notching yoke-engaging position of the sealing yoke corresponding to the withdrawn position of the notching yoke.

5. The combination of claim 3 further comprising:

(q) a fixed strap-cutting blade mounted fixedly in the strapping head; and (r) a movable strap-cutting blade mounted for movement with the sealing yoke;

the fixed and movable strap-cutting blades being adapted to cut one of the overlapped layers of the tensioned loop of steel strap when the punch and dies punch such slits into such layers.

6. The combination of claim 3 wherein the notching yoke has a first intermediate position and a second intermediate position between the withdrawn and extended positions of the notching yoke, and wherein the means (n) connects the notching cutter holder to the notching yoke such that the notching cutter holder does not move with the notching yoke upon movement of the notching yoke from the withdrawn position of the notching yoke, through the first intermediate position o the notching yoke, to the second intermediate position of the notching yoke, such that the notching cutter holder moves with the notching yoke upon movement of the notching yoke from the second intermediate position of the notching yoke, to the extended position of the notching yoke, such that the notching cutter holder does not move with the notching yoke upon movement of the notching yoke from the second intermediate position of the notching yoke, to the first intermediate position of the notching yoke, and such that the notching cutter holder moves with the notching yoke upon movement of the notching yoke from the first intermediate position of the notching yoke to the withdrawn position of the notching yoke.

7. In a strapping head for a strapping machine, in which a sealless connection is made in two overlapped layers of a tensioned loop of steel strap, a combination comprising:

(a) a pair of notching jaws mounted in the strapping head for pivotal movement about parallel notching jaw axes, each notching jaw having a driving end and a working end respectively on opposite sides of one of the notching jaw axes, the notching jaws being pivotable between opened positions and closed positions (b) a notching yoke mounted in the strapping head for movement longitudinally between a withdrawn position and an extended position, the notching yoke having driving end and a working end, the notching yoke being adapted to be driven to and withdrawn from the extended position;

(c) a notching cutter holder mounted in the strapping head for movement longitudinally in relation to movement of the notching yoke;

(d) a pair of notching cutters provided respectively with cutting edges and mounted to the notching cutter holder in spaced relation to each other;

(e) means connecting the notching cutter holder to the notching yoke so as to allow lost motion between the cutter holder and the notching yoke;

(f) means linking the notching jaws to the notching yoke so as to cause the notching jaws to pivot from the opened positions to the closed positions upon movement of the notching yoke from the withdrawn position to the extended position and so as to cause the notching jaws to pivot from the closed positions to the opened positions upon movement of the notching yoke from the extended position to the withdrawn position;

the notching cutters cooperating with the working ends of the notching jaws and being adapted to notch opposite edges of such layers when the notching yoke is driven to its extended position, whereby such edges can be so notched after such slots have interlocked.

8. The combination of claim 7 wherein the notching yoke has a first intermediate position and a second intermediate position between the withdrawn and extended positions of the notching yoke, and wherein the means (e) connects the notching cutter holder to the notching yoke such that the cutter holder does not move with the notching yoke upon movement of the notching yoke from the withdrawn position, through the first intermediate position, to the second intermediate position, such that the notching cutter holder moves with the notching yoke upon movement of the notching yoke from the second intermediate position to the extended position, such that the notching cutter holder does not move with the notching yoke upon movement of the notching yoke moves from the second intermediate position to the first intermediate position, and such that the notching cutter holder moves with the notching yoke upon movement of the notching yoke from the first intermediate position to the withdrawn position.

* * * * *